US008979587B2

(12) United States Patent
Wu et al.

(10) Patent No.: US 8,979,587 B2
(45) Date of Patent: Mar. 17, 2015

(54) CABLE ASSEMBLY HAVING A WIRE MANAGEMENT WITH AN ELECTROPLATED LAYER

(71) Applicant: Hon Hai Precision Industry Co., Ltd., New Taipei (TW)

(72) Inventors: Jerry Wu, Irvine, CA (US); Jun Chen, Kunshan (CN); Zhan-Feng Song, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 21 days.

(21) Appl. No.: 14/017,330

(22) Filed: Sep. 4, 2013

(65) Prior Publication Data

US 2014/0065884 A1 Mar. 6, 2014

(30) Foreign Application Priority Data

Sep. 4, 2012 (CN) ..... 2012 1 0322817

(51) Int. Cl.

| | |
|---|---|
| ***H01R 13/648*** | (2006.01) |
| ***H01R 12/59*** | (2011.01) |
| ***H01R 43/20*** | (2006.01) |
| ***H01R 13/6593*** | (2011.01) |
| ***H01R 13/6599*** | (2011.01) |

(52) U.S. Cl.

CPC ..... *H01R 12/598* (2013.01); *H01R 43/20* (2013.01); *H01R 13/6593* (2013.01); *H01R 13/6599* (2013.01)

USPC ..... 439/607.28

(58) Field of Classification Search

USPC ..... 439/676, 607.01, 607.23, 607.28

See application file for complete search history.

(56) References Cited

U.S. PATENT DOCUMENTS

| | | | | |
|---|---|---|---|---|
| 7,632,155 | B1 * | 12/2009 | Wu | 439/660 |
| 7,651,379 | B1 * | 1/2010 | Wu | 439/660 |
| 7,819,675 | B2 * | 10/2010 | Ko et al. | 439/98 |
| 8,500,494 | B2 * | 8/2013 | Wu | 439/660 |
| 8,597,060 | B2 * | 12/2013 | Wu | 439/660 |
| 2009/0197467 | A1 * | 8/2009 | Ko et al. | 439/607.28 |
| 2012/0156940 | A1 * | 6/2012 | Wu | 439/660 |
| 2012/0156943 | A1 * | 6/2012 | Wu | 439/676 |
| 2014/0220822 | A1 * | 8/2014 | Keyser et al. | 439/607.46 |

FOREIGN PATENT DOCUMENTS

CN 201708323 1/2011

* cited by examiner

*Primary Examiner* — Chandrika Prasad

(74) *Attorney, Agent, or Firm* — Wei Te Chung; Ming Chieh Chang

(57) ABSTRACT

A cable assembly comprises an insulative housing; a plurality of terminals received into the insulative housing; a cable electrically connected to the plurality of terminals. The cable comprises two differential pairs of signal wires. Each differential pair of signal wires comprises two signal wires, a grounding wire and a shielding layer surrounding the two signal wires and a grounding wire. Front end regions of the signal wires and the grounding wires are exposed out of the shielding layer. And, a wire management is assembled to a rear end of the insulative housing and defines a plurality of channels respectively plated with an electroplated layer. The front end regions of the signal wires and the grounding wires are respectively passed through the plurality of channels and electrically connected to the corresponding terminals.

16 Claims, 5 Drawing Sheets

CABLE ASSEMBLY HAVING A WIRE MANAGEMENT WITH AN ELECTROPLATED LAYER

BACKGROUND OF THE INVENTION

1. Field of the Invention

The present invention relates to a cable assembly, and more particularly to a cable assembly for high speed signal transmission.

2. Description of Related Art

CN. Patent No.201708323U issued to Wu on Jan. 11, 2011 discloses a cable assembly comprising: a plurality of second terminals, an insulative housing molding outside the second terminals, a plurality of second terminals received in the housing, a flat cable electrically and mechanically connecting to the first and second terminals and a metallic shell shielding the insulative housing. And the flat cable comprises a plurality of inner conductors arranged into an upper row and a lower row. The upper row of the inner conductors are soldered to the second terminals and the lower row of the inner conductors are soldered to the second terminals. The flat cable further comprises a plurality of inner insulative layers respectively surrounding the corresponding inner conductors and a plurality of shielding layers respectively surrounding the corresponding inner insulative layers and an outer insulative layer surrounding the shielding layers.

However, if the shielding layer of the flat cable is not cut out for a long enough distance. As a result, the inner conductors are not convenient to solder to the first and second terminals. And, if the shielding layer of the flat cable is cut out for a too long distance. Thus, a crosstalk problem will be occurred between two adjacent inner conductors. In addition, the inner conductors are not easily positioned due to a lack of wire management of the cable assembly.

Thus, an improved cable assembly overcoming shortages of existing technology is needed.

SUMMARY OF THE INVENTION

Accordingly, an object of the present invention is to provide a cable assembly with an improved wire management to effectively improve the characteristic impedance mutation phenomenon and prevent crosstalk.

In order to achieve the object set forth, a cable assembly a cable assembly comprises an insulative housing; a plurality of terminals received into the insulative housing; a cable electrically connected to the plurality of terminals, the cable comprising two differential pairs of signal wires, each differential pair of signal wires comprising two signal wires, a grounding wire and a shielding layer surrounding the two signal wires and a grounding wire, front end regions of the signal wires and the grounding wires exposed out of the shielding layer; and a wire management assembled to a rear end of the insulative housing and defining a plurality of channels respectively plated with an electroplated layer, the front end regions of the signal wires and the grounding wires respectively passed through the plurality of channels and electrically connected to the corresponding terminals.

Other objects, advantages and novel features of the invention will become more apparent from the following detailed description when taken in conjunction with the accompanying drawings.

DETAILED DESCRIPTION OF THE PREFERRED EMBODIMENT

Figure 1:
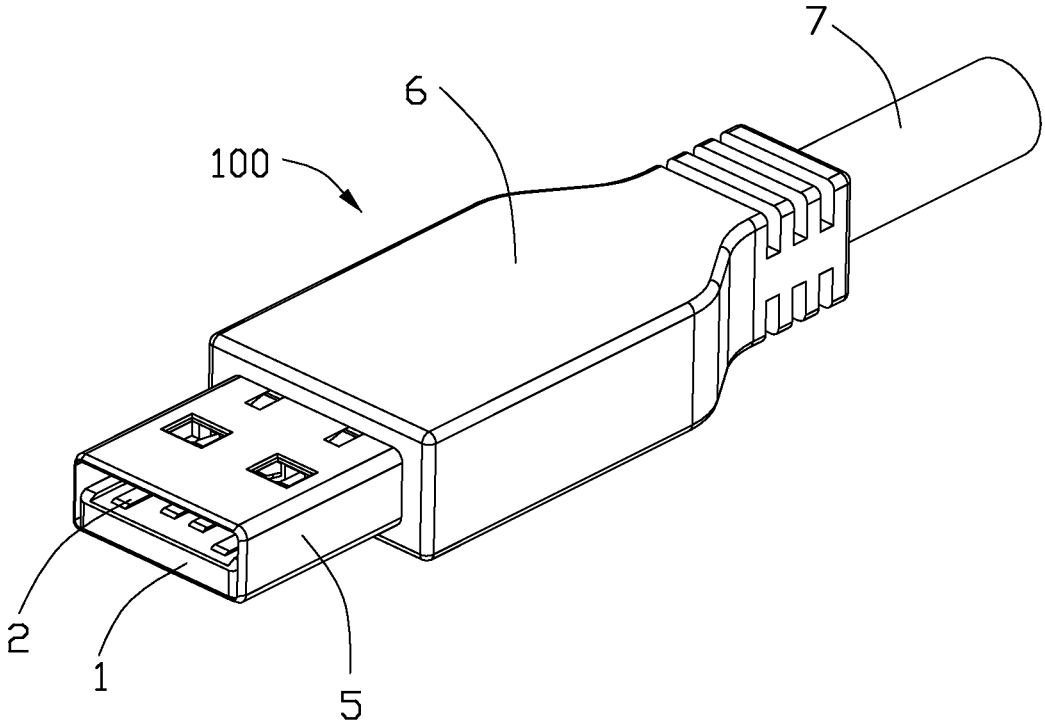
FIG. 1 is an assembled, perspective view of a cable assembly in accordance with the present invention.
Figure 2:
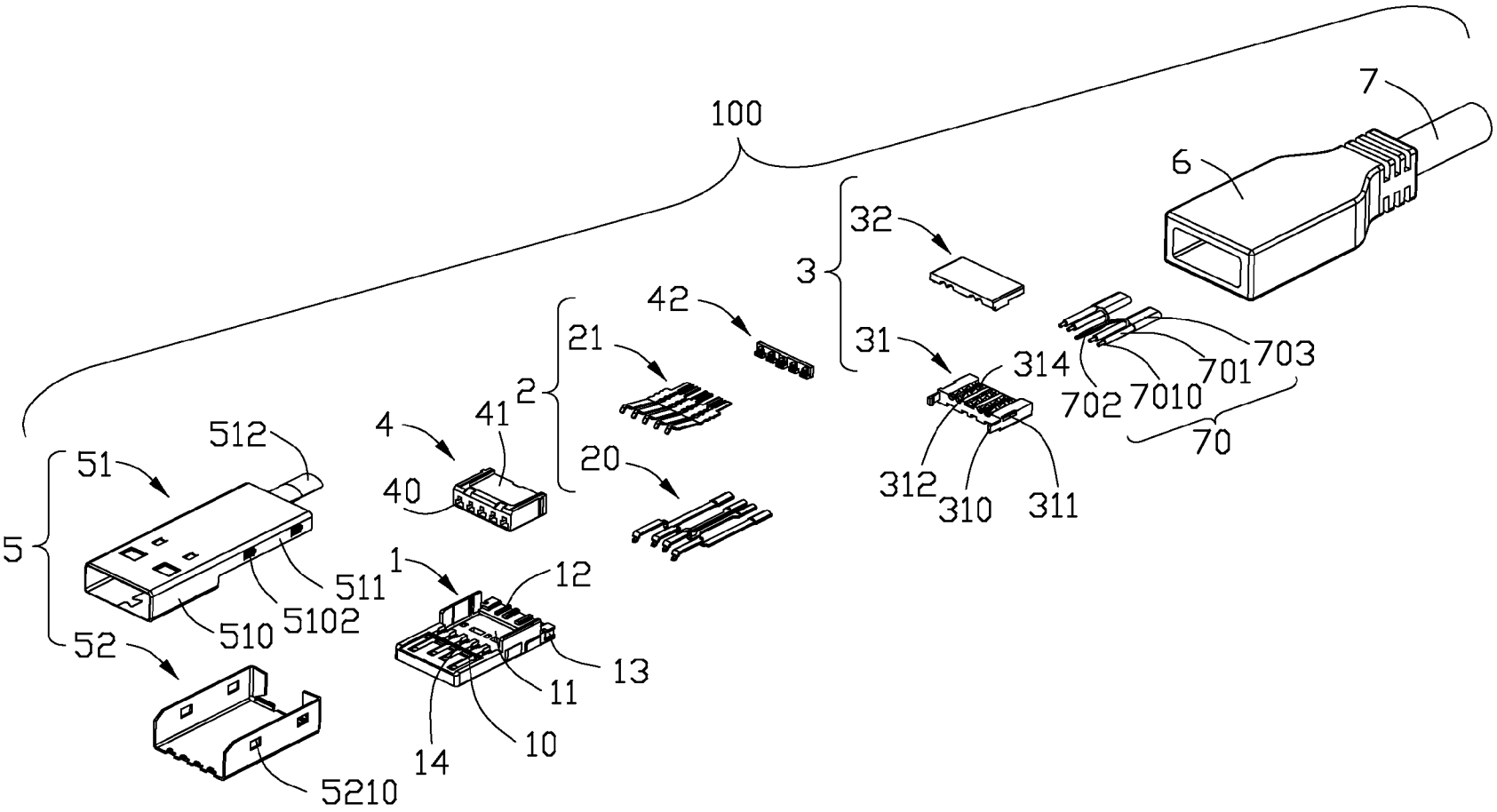
FIG. 2 is an exploded, perspective view of a cable assembly of FIG. 1.

Reference will now be made in detail to the preferred embodiment of the present invention. Referring to FIGS. 1 to 2, a cable assembly 100 comprises an insulative housing 1 assembled with an insulator 4, a plurality of terminals 2 received into the insulative housing 1 and the insulator 4, a wire management 3 assembled to a rear end of the insulative hosing 1, a metallic shell 5 shielding the insulative housing 1, a cable 7 electrically connected to the terminals 2, and an insulative cover 6 covering a rear portion of the metallic shell 5.

Figure 3:
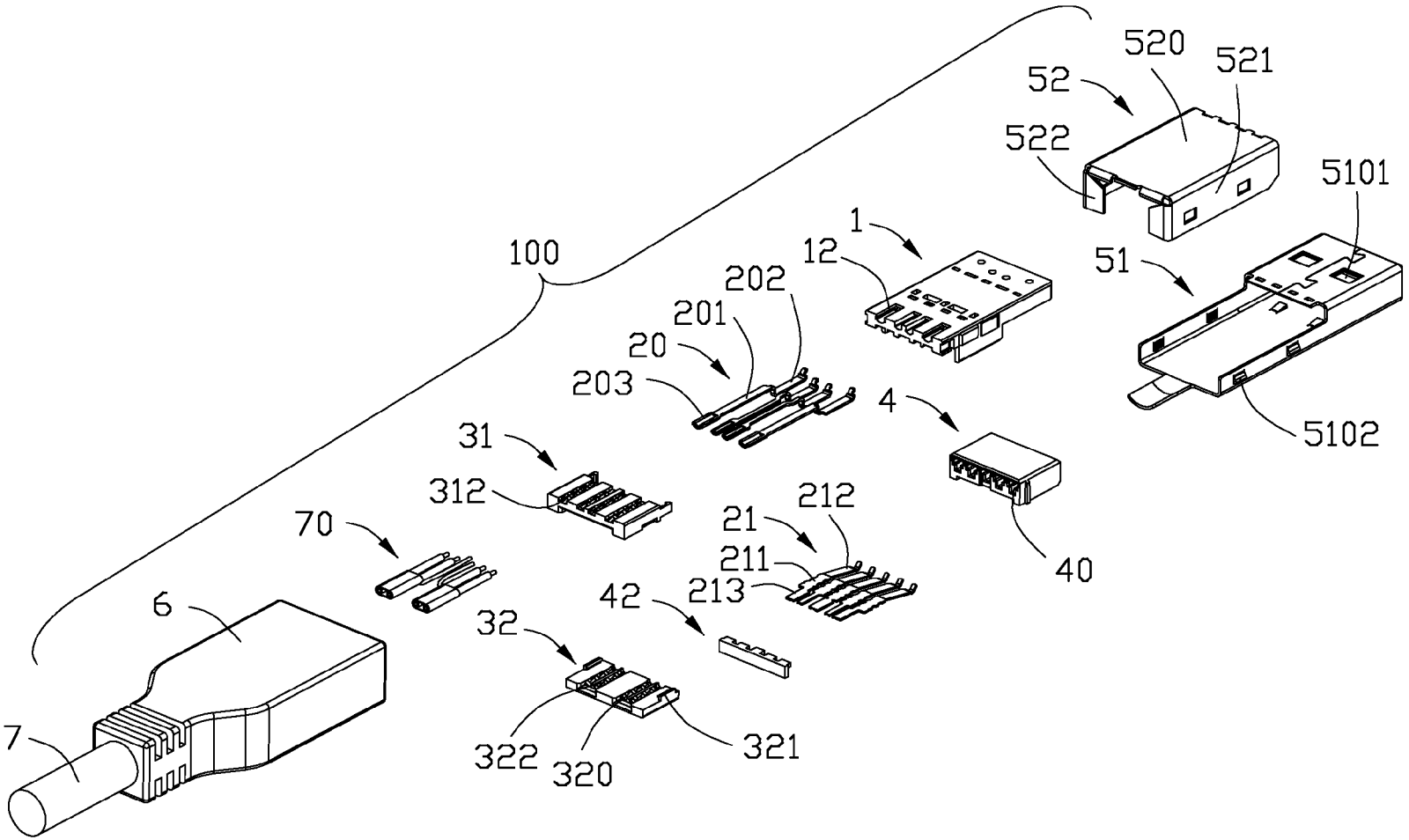
FIG. 3 is another exploded view similar to FIG. 2, taken from anther aspect.
Figure 4:
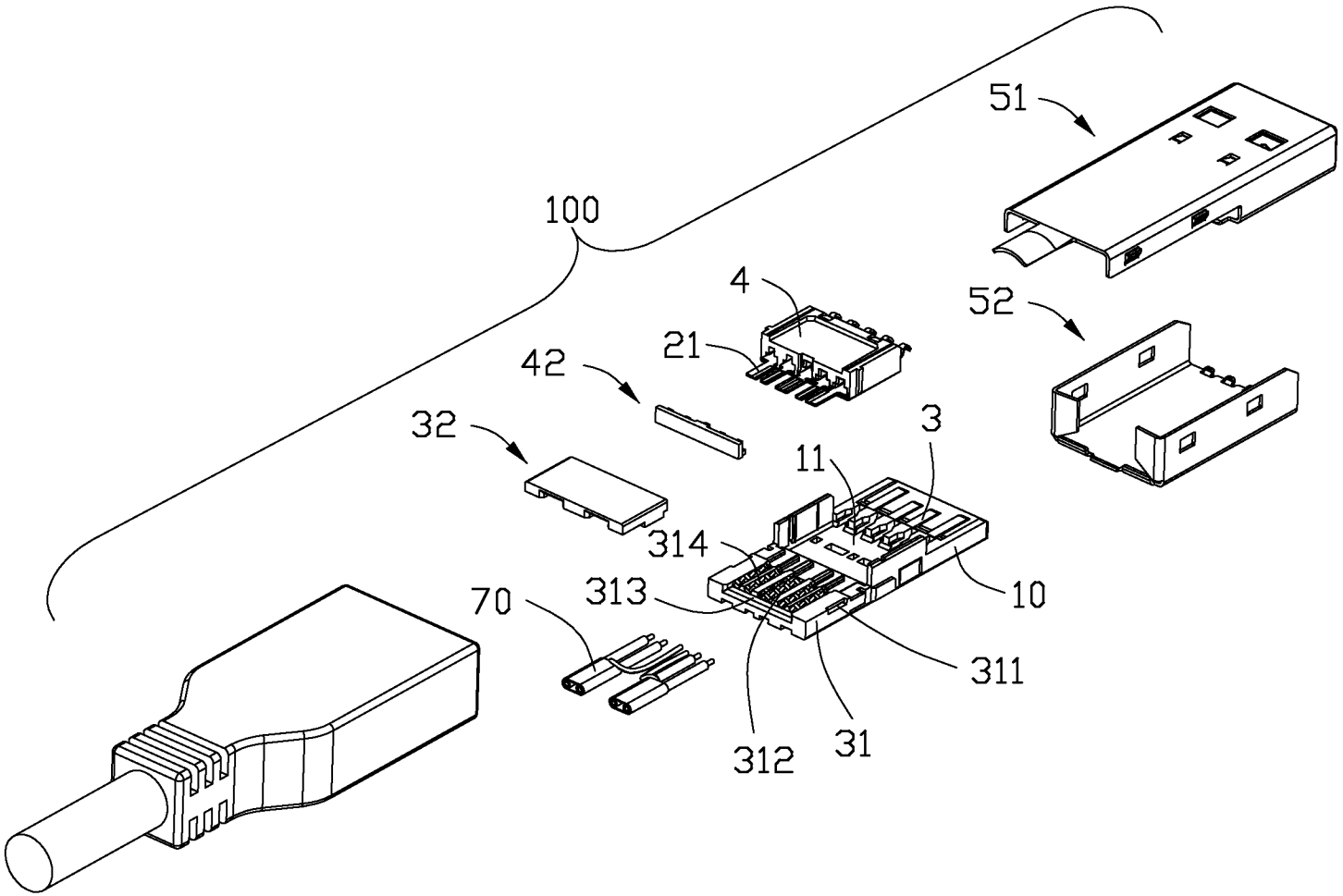
FIG. 4 is a partially assembled, perspective view of a base portion of a wire management assembled to an insulative housing of a cable assembly and a plurality of terminals received into the insulative housing of FIG. 2.
Figure 5:
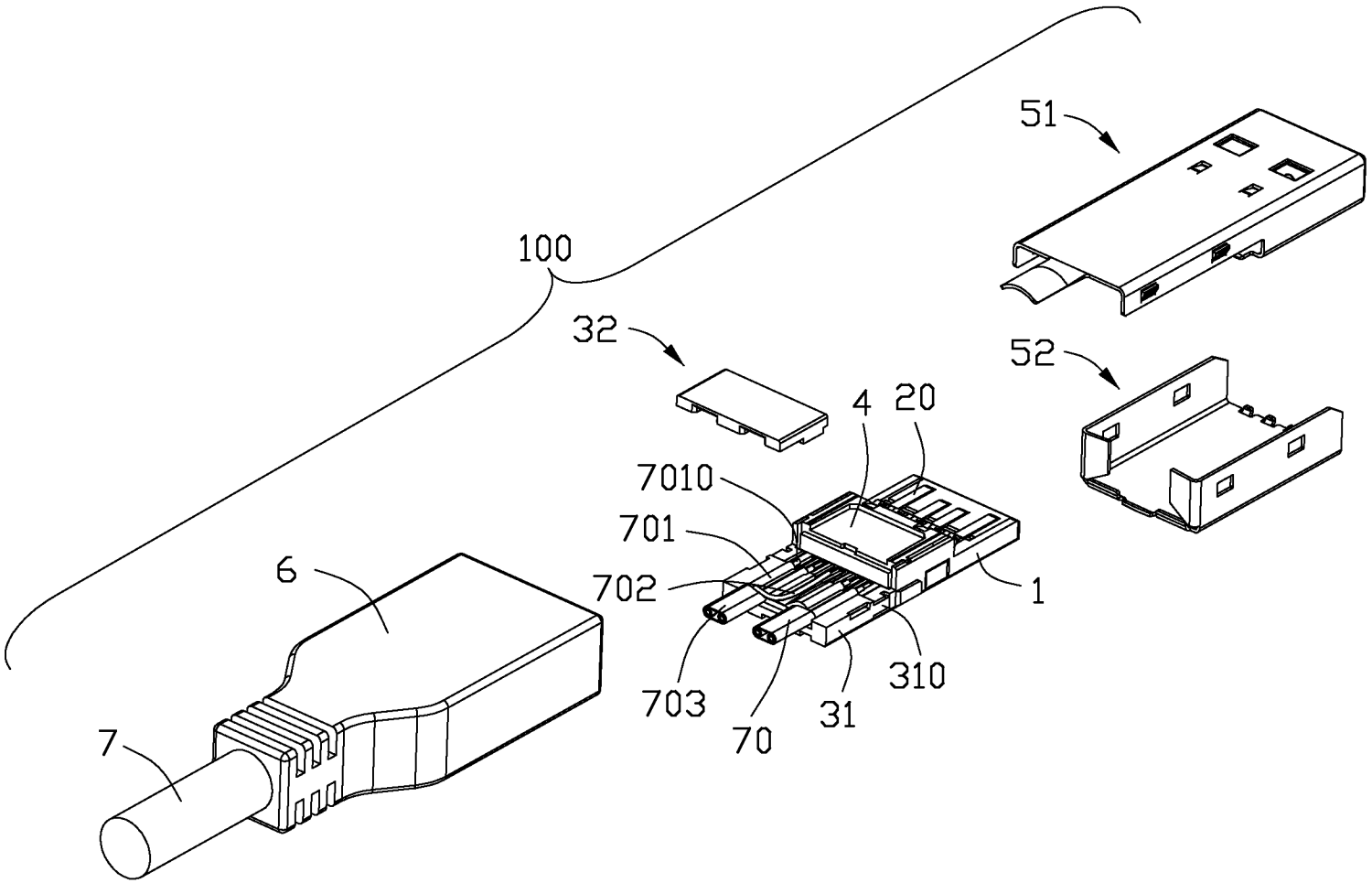
FIG. 5 is another partially assembled, perspective view of FIG. 4.

Referring to FIGS. 2 to 3, a plurality of terminals 2 comprise a set of first terminals 20 and a set of second terminals 21. Both the first terminal 20 and the second terminal 21 comprise a planar retention portion 201, 211 supported by the insulative housing 1, a mating portion 202, 212 extending forwardly from the retention portion 201, 211 and a tail portion 203, 213 extending rearwardly from the retention portion 201, 211. The mating portions 202 of the first terminals 20 are flat and stiff. And the mating portions 212 of the second terminals 21 are curved and elastic.

Referring to FIGS. 2 to 5, the insulative housing 1 is structured in a rectangular shape and has a U-shaped body portion (not figured) and a tongue portion (not figured) extending forwardly from the body portion. The insulative housing 1 defines a top surface and an opposite bottom surface. The U-shaped base portion defines a mounting cavity 11 recessed downwardly from the top face of the body portion. The insulative housing 1 defines a row of first terminal receiving passages 14 formed on the top surface of the insulative housing 1 and located in front of the mounting cavity 11 for receiving mating portions 212 of the set of second terminals 21, and a row of second terminal receiving passages 10 located in front of the row of first terminal receiving passages 14 for receiving the mating portions 202 of the set of second terminals 20. The insulative housing 1 further defines a plurality of grooves 12 formed on two opposite top and bottom surfaces for receiving tail portions 203, 213 of the first and second terminals 20, 21 and a pair of indentations 13 formed on two side surfaces thereof.

Referring to FIGS. 2 to 5, the insulator 4 is assembled to the insulative housing 1 along a vertical direction and defines a plurality slots 40 throughout front and rear surfaces thereof. The insulator 4 also defines a recesses 41 formed on a top surface thereof. The second terminals 20 are respectively received into the corresponding slots 40. The retention portions 211 of the second terminals 21 are supported by the slots 40, the mating portions 212 of the second terminals 21 extend forwardly from a front surface of the insulator 4 for a distance, and the tail portions 213 of the second terminals 21 extend rearwardly from a rear surface of the insulator 4 for a distance. The insulator 4 is mounted into the mounting cavity 11 of the insulative housing 1 to form an insulative piece. Thus, mating portions 212 of the second terminals 21 are received into the row of first terminal receiving passages 14 and located in back of the mating portions 202 of the first terminals 20. The tail portions 213 of the second terminals 21 are received into the grooves 12 formed on the top surface of the insulative housing 1. A blocking piece 42 is assembled to a rear end of the insulator 4 to cover rear ends of the slots 40.

Referring to FIGS. 2 to 5, the wire management 3 is assembled to a rear end of the insulative housing 1. The wire management 3 is made of plastic material and comprises a base portion 31 and a cover portion 32 assembled to the base portion 31 along a vertical direction. The base portion 31 defines two arms 31 respectively extending forwardly from two lateral sides thereof. The base portion 31 has two rows of troughs 312 respectively formed on an upper and lower faces thereof and extending along a longitudinal direction, and a recess 313 formed on the upper surface and located in back of a row of troughs 312. The recess 313 is communicated with the row of troughs 312 and extended along a transverse direction. The troughs 312 and recess 313 formed on the upper surface of the base portion 31 are plated with metallic material to form an electroplated layer 314. The cover portion 32 also defines a row of troughs 320 formed on the bottom surface thereof. The row of troughs 320 are also plated with metallic material to formed another electroplated layer 322. The base portion 31 also defines two cutouts 311 formed on two lateral sides thereof. The cover portion 32 is covered to the base portion 31 to form a receiving room(not figured). The cover portion 32 defines two latching portions 321 cooperated with two cutouts 311 to achieve an engagement between the base portion 31 and the cover portion 32. When the base portion 31 is assembled to the cover portion 32, a plurality of channels are formed by the troughs 312, 320.

Referring to FIGS. 1 to 4, the cable 7 comprises two differential pairs of signal wires 70 and other four wires (not shown) respectively located on two different plans. Each of the pair of signal wires 70 comprises two signal wires 701, a grounding wire 702 and a shielding layer 703 made of aluminum foil surrounding the two signal wires 701 and a grounding wire 702. The signal wire 701 comprises a conductor 7010 and an outer insualtive layer (not figured). The four signal wires 701 and two grounding wires 702 are received in a row of troughs 312 and electrically connected with the tail portions 213 of the second terminals 21. And the four signal wires 701 and two grounding wires 702 are sandwiched between the base portion 31 and the cover portion 32. Two grounding wires 702 of two pairs of signal wires 70 are firstly extended into the recess 313 and then received into a trough 312. Two front end regions of the two shielding layers 703 of two signal wires 701 are located in the recess 313. The other four wires are received into another row of troughs 312 and electrically connected with the tail portions 203 of the first terminals 20.

Referring to FIGS. 2 to 5, the metallic shell 5 comprises a first shielding piece 51 and a second shielding piece 52 assembled with each other along a vertical direction. The first shielding piece 51 comprises a front frame portion 510, a n-shaped portion 511 rearwardly extending from a top side of the front frame portion 510, and a cable holder 512 extending rearwardly from a rear edge of top section of the n-shaped portion 511. An upper and a lower wall of the front frame portion 510 respectively defines two windows. Each side of n-shaped portion 511 defines two locking tabs 5102. The second shielding piece 52 is U-shaped and comprises a bottom section 520, a pair of side sections 521 extending upwardly from two sides of the bottom section, and two back sections 522 spaced apart with each other. The pair of side sections 521 respectively defines two locking holes 5210 cooperated with locking tabs 5102 of the n-shaped portion 511 of the first shielding piece 51.

In this embodiment, the wire management 3 is formed by two separated pieces. The top surface of the base portion 31 and the bottom surface of the cover portion 32 are both plated with metallic material. In other embodiment, the wire management 3 is formed by an unitary piece. And, an inner surface of the wire management 3 are plated with metallic material. In this embodiment, the base portion 31 and the cover portion 32 are both made of insulative material easily and suitable to be plated. In other embodiment, only troughs 312, 320 where two differential pairs of signal wires 70 passed through are made of insulative material easily and suitable to be plated for saving manufacturing cost. Then, the troughs 310, 320 are plated with metallic material.

After the above describing, the entire solution of the cable assembly 100 is disclosed. As the cable assembly 100 comprises a wire management 3 plated an electroplated layer 314, 322 therein and the grounding wire 702 is contacted to the electroplated layer 314, 322, so the shielding layer 703 is electrically connected to the electroplated layer 314, 322 through the grounding wire 702. Thus, a grounding loop is formed between the shielding layer 703 and the electroplated layer 314, 322 to achieve a shield compensation of the shielding layer 703. So, the shielding layer 703 can be cutout for a long distance for the signal wires 701 and the grounding wire 702 easily connected to the terminals 2. In addition, characteristic impedance mutation phenomenon of the cable assembly 100 will be overcome. And, the crosstalk between the differential pairs of wires 70 can be well prevented.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

an insulative housing;

a plurality of terminals received into the insulative housing;

a cable electrically connected to the plurality of terminals, the cable comprising two differential pairs of signal wires, each differential pair of signal wires comprising two signal wires, a grounding wire and a shielding layer surrounding the two signal wires and a grounding wire, front end regions of the signal wires and the grounding wires exposed out of the shielding layer; and a wire management located around a rear end of the insulative housing and defining a plurality of channels respectively plated with an electroplated layer, the front end regions of the signal wires and the grounding wires respectively passed through the plurality of channels and electrically connected to the corresponding terminals.

2. The cable assembly as claimed in claim 1, wherein the wire management comprises a base portion and a cover portion assembled with each other along a vertical direction.

3. The cable assembly as claimed in claim 2, wherein the base portion defines two arms respectively extending forwardly from the two lateral sides thereof and engaged with a pair of indentations formed on two side surfaces of the insulative housing.

4. The cable assembly as claimed in claim 2, wherein the base portion defines a plurality of troughs formed on a top surface thereof, and the cover portion defines a plurality of troughs formed on a bottom surface, the plurality of channels are formed by the troughs.

5. The cable assembly as claimed in claim 4, wherein the cover portion defines two latching portions cooperated with two cutouts formed at two sides of the base portion to achieve an engagement between the base portion and the cover portion.

6. The cable assembly as claimed in claim 1, wherein the cable assembly further comprises a metallic shell enclosing the insulative housing and an insulative cover covering a rear portion of the metallic shell.

7. The cable assembly as claimed in claim 6, wherein the metallic shell comprises a first shielding piece and a second shielding piece assembled with each other along a vertical direction.

8. The cable assembly as claimed in claim 1, wherein the wire management comprising a base portion and a cover portion assembled with each other along a vertical direction, at least one of the base portion and cover portion defines said channels.

9. The cable assembly as claimed in claim 8, wherein the front end regions of the signal and grounding wires are sandwiched between the base portion and the cover portion and contacted with the electroplated layer, and the electroplated layer is electrically contacted to the shielding layer through grounding wires.

10. The cable assembly as claimed in claim 1, wherein each signal wire includes an inner conductor enclosed within an insulative layer, and said inner conductor extends beyond the insulative layer to be soldered upon the corresponding terminal.

11. A method of assembling a cable connector, comprising steps of:

providing an insulative housing with a plurality of contacts, each of said contacts including a front mating section and a rear connecting section, said contacts being categorized with at least one differential pair of signal contacts and a grounding contact;

providing a cable with at least one differential pair of signal wire unit including two signal wires in pair and one grounding wire commonly enclosed within a shielding layer, said two signal wires forwardly extending beyond and outside of a front end of the shielding layer, respectively, each of said signal wires including an inner conductor enclosed within the insualtive layer, in each signal wire the inner conductor forwardly extending beyond and outside of a front end of the corresponding insulative layer for electrically connecting to the rear connecting section of the corresponding signal contact; and providing a shielding structure to essentially circumferentially enclose the exposed insulative layer which forwardly extends beyond and outside of the front end of the shielding layer, wherein the shielding structure is an electroplated layer formed upon the wire management device located behind the rear connecting sections of the contacts.

12. The method of assembling the cable connector as claimed in claim 11, wherein said wire management device defines a plurality of channels coated with said electroplated layer therein.

13. The method of assembling the cable connector as claimed in claim 11, wherein the grounding wire is mechanically and electrically connected to the shielding structure and further to the corresponding rear connecting section of the grounding contact.

14. A cable connector assembly comprising:

an insulative housing;

a plurality of contacts disposed in the housing, each of said contacts defining a front mating section and a rear connecting section;

a wire management device located behind the rear connecting sections of the contacts with a shielding structure thereof; and a cable equipped with at least one differential pair of signal wire unit including two signal wires in pair and one grounding wire commonly enclosed within a shielding layer, said two signal wires forwardly extending beyond and outside of a front end of the shielding layer, respectively, each of said signal wires including an inner conductor enclosed within the insualtive layer, in each signal wire the inner conductor forwardly extending beyond and outside of a front end of the corresponding insulative layer for electrically connecting to the rear connecting section of the corresponding signal contact; wherein said shielding structure essentially fully surrounds the exposed insulative layer which extends forwardly beyond the front end of the shielding layer, wherein the exposed insulative layer is received in a corresponding channel in the wire management device and the shielding structure is an electroplated layer coated on the channels.

15. The cable connector assembly as claimed in claim 14, wherein said inner conductor is directly mechanically connected to the rear connecting section of the corresponding signal contact.

16. The cable connector assembly as claimed in claim 14, wherein a grounding path is established by the grounding wire which mechanically and electrically connects to the grounding contact, the shielding structure, and the shielding layer successively, along a front-to-back direction.

* * * * *